United States Patent [19]

Dizek et al.

[11] Patent Number: 4,515,629

[45] Date of Patent: May 7, 1985

[54] DEGASSING METAL POWDER

[75] Inventors: Frederick A. Dizek, Westfield, Mass.; Eric S. Vogel, Manchester, Conn.; C. John Tiedeman, Jr., East Hartford, Conn.; Robert A. Herold, Tolland, Conn.

[73] Assignee: United Technologies Corporation, Hartford, Conn.

[21] Appl. No.: 233,726

[22] Filed: Feb. 12, 1981

[51] Int. Cl.[3] ..... C21D 1/00

[52] U.S. Cl. ..... 75/0.5 B; 148/126.1; 34/178; 55/193; 264/71; 264/102; 75/251

[58] Field of Search ..... 148/126; 75/0.5, 0.5 B, 75/0.5 BA, 224, 225, 251; 34/178; 264/102, 71; 55/190–93

[56] References Cited

U.S. PATENT DOCUMENTS 2,198,612 4/1940 Hardy ..... 264/71

2,278,701 4/1942 Korr ..... 34/178 X 3,190,729 7/1965 Emmett et al. ..... 34/178

4,063,940 12/1977 Dain et al. ..... 75/225 X

FOREIGN PATENT DOCUMENTS 721866 1/1955 United Kingdom .

*Primary Examiner*—John Doll

*Assistant Examiner*—Bob Stoll

*Attorney, Agent, or Firm*—C. G. Nessler; A. J. Criso

[57] ABSTRACT

Apparatus and method for degassing fine powders of metals are disclosed. A vertical shell having a series of baffle plates inclined at an angle of repose is used to induce a serpentine path for the powder. The shell is subjected to suitable conditions of vibration temperature and pressure to maintain the desired flow rate and gas separation. Conditions of mesh size, pressure temperature, angle of repose as well as equipment configuration are discussed.

2 Claims, 2 Drawing Figures

FIG. 1
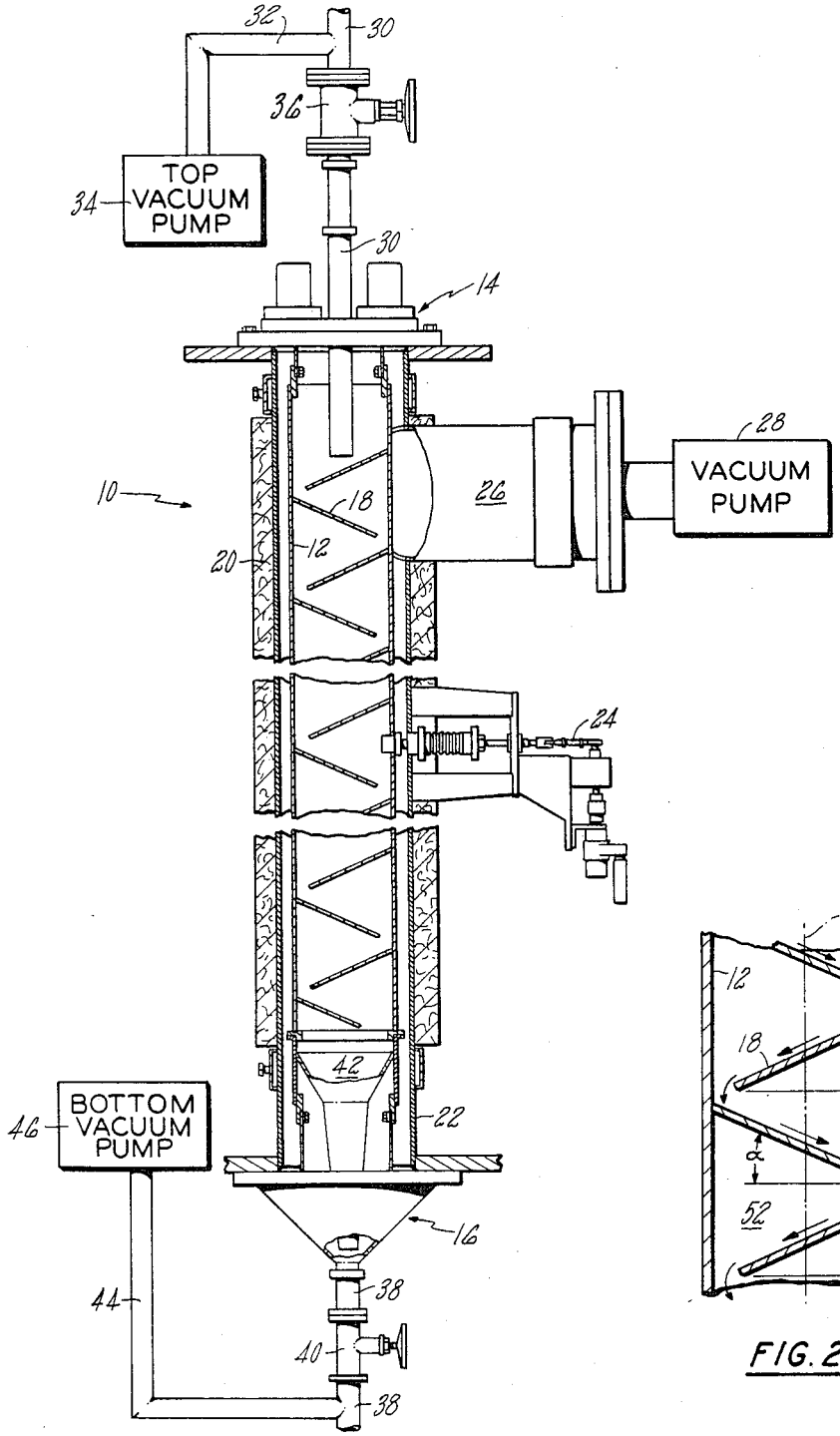
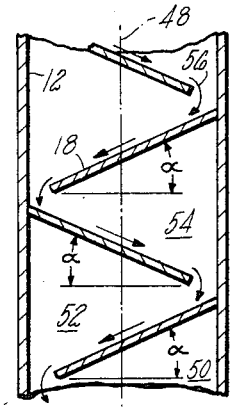
FIG. 2

DEGASSING METAL POWDER

BACKGROUND

The present invention relates directly to the processing of metal powder and more particularly to a vertical chamber for degassing metal powders.

Metal powders occur some times as a by-product from a finishing process and at times they come into being intentionally as one of the intermediate steps in the formation of a finished metal product. In either event, there are various incentives for separating the metal powders from various contaminants or foreign materials which are mixed in with the metal powder. The primary separating techniques involve either heating the metal powder in a suitable reducing atmosphere, reacting the metal powder with an appropriate chemical reagent, or activating the powder by impact with energetic particles.

U.S. Pat. No. 3,954,458, Degassing Powder Metallurgical Products, teaches a powder metal degassing method. The powder in a compact which is considerably less than one hundred percent dense is subject to a very low absolute pressure and a temperature in the four hundred to eight hundred degree range for an amount of time which is dependent upon several factors including the size of the compact when the gas is removed. U.S. Pat. No. 2,329,862, Apparatus and Process for Treating Metal Powders, teaches the decarburization of iron powder containing chemically combined carbon. The powder is placed on a continuously moving horizontal support and passed through a hot zone. Variations on these concepts involving appropriate conditions of pressure and temperature are also known. Techniques for removing contaminants from fine metal powders which result from metal grinding operations are disclosed in U.S. Pat. No. 3,032,409, Metal Powder Purification. Organic contaminants such as oil, soap and detergents are removed by first dropping the contaminated powder through a current of hot gas and then mechanically advancing this powder through a second heating zone while agitating the powder in a horizontal drum. The application of magnetic fields electrostatic separation and air blowing techniques to additionally separate metal or carbon particles is also disclosed.

The chemical degassing of a powder is taught in U.S. Pat. No. 3,511,640, Degassing Platinum Powders. The specification teaches mixing finely divided platinum powder with a diluent metal oxide powder for a sufficiently long time at elevated temperature to separate the gases from the platinum powder. After the proper mixture has been maintained at temperature sufficiently, the material is cooled and the platinum powder separated from the metal oxide.

The third technique for removing impurities from metal powders is taught in such patents as U.S. Pat. No. 3,738,828, Method of Powder Activation and U.S. Pat. No. 4,005,956, Powder Activation and Integrated Powder Metallurgy System. The essence of these patents is to subject the powder to bombardment with high energy particles including electrons, ions or molecules in an appropriate inert or reducing atmosphere for removing the unwanted impurities from the powder.

Although such techniques for processing metal powder are known, industry is still in need of inexpensive equipment which is practical to operate and does a superior job of separating gas from metal powder.

SUMMARY OF THE INVENTION

A primary objective of the present invention is to control the flow of fine metal powder while separating the gases from the metal which are mixed with or adhered to the metal powder.

According to the present invention, a vertical chamber having a centerline axis includes baffle plates which extend seriatim from alternate sides of the chamber is combined with vacuum, heating and vibration means to form a machine for controlling the flow and texture of any fine powder which is passed through the chamber. Each baffle plate is inclined at a dynamic angle of repose and extends more than half way across the chamber. During a procedure such as the degassing of a metal powder, the powder is admitted to the chamber at the top and follows a serpentine course down through the chamber while exposed to preselected conditions of temperature and pressure with the flow being controlled by an induced vibration of the chamber. The powder on the inclined baffle plates is stable and the throughput flow rate of the powder is controlled by suitably vibrating the chamber.

A primary feature of the apparatus according to the present invention is the vertical chamber which supports a shell in the degassing apparatus. In a preferred embodiment, the shell is cylindrical and has baffle plates extending inwardly. Each baffle plate is basically flat and is attached to the shell at a very precisely controlled angle referred to as the angle of repose. The chamber includes means for applying heat to the enclosed region defined by the shell. The shell is adapted to be vibrated as necessary and, means for maintaining vacuum conditions inside the shell are provided.

The present invention permits a high degree of gas removal from metal powders such as alloys used in hot isostatic press manufacturing techniques. This invention provides very accurate control over the flow of powder during the degassing process so that shipping and manufacturing containers can be filled with precision. The apparatus disclosed is relatively small, inexpensive to build, and convenient to operate. Most parts of the system are easily accessible facilitating maintenance. Further, the apparatus according to the present invention, avoids allowing the metal powder to form into lumps and move unevenly and to the extent the powder tends to lump, the flow rate is made more even because the lumps break while passing through this machine.

The foregoing and other objects, features and advantages of the present invention will become more apparent in the light of the following detailed description of preferred embodiments as illustrated in the accompanying drawing and described in more detail hereinafter.

BRIEF DESCRIPTION OF THE DRAWING

FIG. 1 is a partially broken away elevation view of apparatus in accordance with the present invention including the outside chamber, the vertical shell and baffle plates; and FIG. 2 is a schematic drawing of several of the adjacent baffle plates from FIG. 1 illustrating in greater detail the baffle structure.

DESCRIPTION OF PREFERRED EMBODIMENT

A preferred embodiment of apparatus in accordance with the present invention is shown in FIG. 1. A chamber assembly 10 is comprised of a vertical shell 12, a top closure assembly 14 and a bottom closure assembly 16 with baffle plates 18 extending inwardly from the shell. Surrounding the shell is a heater blanket 20 which is fixed to a support wall 22 and extends substantially throughout the entire shell. The blanket is penetrated by a vibrator means 24 which directly engages the vertical shell and a vacuum connector 26 which joins the interior of the chamber assembly with a main vacuum pump 28.

The top closure assembly 14 is penetrated by an entry pipe 30 which allows the metal powder to be admitted into the vertical shell. A top vacuum connector 32 joins the entry pipe with a top vacuum pump 34. The entry pipe contains a top shutoff valve 36. The bottom closure assembly 16 is penetrated by an exit pipe 38 which contains a bottom shutoff valve 40. Also shown at the bottom of the chamber assembly is a funnel 42 which empties into the exit pipe, and a bottom vacuum connector 44 which joins the exit pipe with a bottom vacuum pump 46.

The baffle orientation with respect to a centerline axis 48 of the vertical shell is shown more clearly in FIG. 2. The shell defines an enclosed region 50 which is divided for the purposes of definition into a first subregion 52 which is the volume to the left of the axis 48 and a second subregion 54 which is the volume to the right of this axis. The centerline axis is maintained vertical and each baffle plate is oriented at an angle of repose with respect to the axis 48. Alternate baffle plates extend inwardly from the shell into the enclosed region and are parallel to each other. Each baffle which is essentially a flat plate extends from the shell to a location beyond the centerline axis thereby forming an opening between the free edge of the plate and the shell.

The angle of repose as used herein means the maximum angle with the horizontal at which loose material such as metal powder, ceramics, grain and sand will retain its position on a flat plate without sliding. In the present invention the angle of repose has been determined to be twenty three degrees although up to a two degree variation is considered acceptable particularly with metal powders.

The operation of the apparatus shown in the drawing is described for a circular chamber assembly approximately eight feet high and two feet in diameter as used to degas several hundred pounds of metal powder such as a nickel-base alloy with a mesh size as small as −325. A sealed shipping container loaded with the metal powder to be processed is attached at the top shutoff valve and an empty receiver can is attached at the bottom shutoff valve. Neither the shipping container nor the receiver can is shown in the drawing. The vacuum pumps are energized to reduce the pressure inside the vertical shell to less than about one torr. At an appropriate time the heater blanket is activated to raise the temperature of the vertical shell to at least about five hundred degrees Fahrenheit. Once the system has reached steady state with respect to pressure and temperature, the vibrator means is started and powder is admitted through the entry pipe with the top shutoff valve. The powder falls under the influence of gravity and would tend to pile up on the upper baffle plates but for the induced vibration of the vertical shell.

Operating experience teaches that a dynamic angle of repose of fifteen degrees is actually preferred in many practical manufacturing environments. Vibration from nearby but unrelated equipment is present in the vertical shell so that even without any contribution from the vibrator means 24, the powder moves off the baffle plate at a rate faster than is desired for degassing. Thus the realities of the equipment dictate a dynamic angle of repose rather than the ideal static angle of repose which respresents a vibrationless environment. Unless the dynamic angle of repose and the vibration of the vertical shell are coordinated, the flow rate of powder through the chamber can be so slow as to be impractical or so fast that an inadequate degree of degassing is permitted to occur.

As the powder moves from baffle plate to baffle plate under the influence of gravity and vibration a serpentine path 56 is defined by the powder cascading to the bottom of the shell. The powder is collected by the funnel and delivered to the receiver can through the exit pipe. To the extent that the powder tends to form into lumps, both the vibration and the short vertical drop between baffle plates even out the flow and eliminates lumping.

The powder is not preheated before being admitted to the chamber although it does approximate the temperature of the vertical shell before reaching the funnel. The flow rate of the powder is typically between five and thirty pounds per minute and very often approximately fifteen pounds per minute is preferred. To fill an ordinary receiver can with three hundred pounds of powder takes approximately one hour even though the residence time in the chamber for powder particles is measured in minutes. The filling process involves a continuous run with the operator shutting off the vibrating means when the receiver can is approaching full. Small increments of powder are added by turning on and shutting off the vibrator as necessary. A viewing port between the bottom shutoff valve 40 and the receiving can assists in the final steps of filling.

The vibration means 24 is a rotary device driven eccentrically with a motor. The amplitude of the offset is variable and changes therein can be used to change the rate at which the powder cascades through the shell.

The descriptions provided above are with respect to particular apparatus and conditions of operation however various alternatives and refinements are within the scope of the invention. For example, the apparatus is readily adapted to material other than metal powder such as grain, or ceramics. Also, while the vertical shell is described as circular in cross section, the element also functions if square, rectangular or otherwise. Further, consideration has to be given to such variables as the size and abrasiveness of the throughput material as well as its compatibility with the structural elements particularly the vertical shell and the baffle plates.

The present invention has been shown and described with respect to preferred embodiments thereof however, those skilled in the art should recognize that various changes and omissions in the form and detail thereof may be made without departing from the spirit or scope of the present invention.

Thus having described typical embodiments of our invention that which we now claim as new and desire to secure by Letters Patent of the United States is:

1. The method of degassing a metal powder in an enclosed vertical shell containing a plurality of opposing inclined baffle plates fixed to the shell and positioned to cause powder to drop alternately in a downward direction from one baffle plate to the next along the vertical length of a region of the shell, characterized by measuring the static angle of repose of the the powder with respect to a horizontal and fixing the incline of the baffle plates at an angle with respect to the horizontal which is less than said static angle of repose; evacuating said region and heating said region to at least 500° F.; vibrating said region and the baffle plates contained therein to control the rate of powder flow across the baffles and along the said vertical length; and collecting the powder at the bottom of the shell.

2. The method of claim 1 wherein the tower is evacuated to a pressure of 1 torr or less.

* * * * *